US008714261B2

(12) United States Patent
Sbordone et al.

(10) Patent No.: US 8,714,261 B2
(45) Date of Patent: May 6, 2014

(54) SUBSEA DEPLOYMENT OF SUBMERSIBLE PUMP

(75) Inventors: Andrea Sbordone, Costa del Sol (SG); Rene Schuurman, The Trevose (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 815 days.

(21) Appl. No.: 12/607,725

(22) Filed: Oct. 28, 2009

(65) Prior Publication Data

US 2010/0116506 A1 May 13, 2010

Related U.S. Application Data

(60) Provisional application No. 61/112,629, filed on Nov. 7, 2008.

(51) Int. Cl.
*E21B 34/04* (2006.01)
*E21B 29/12* (2006.01)

(52) U.S. Cl.
USPC ..... 166/338; 166/368; 166/360; 166/345

(58) Field of Classification Search
USPC ..... 166/338, 339, 344–346, 351, 352, 367, 166/369, 381, 385, 68, 77.1, 77.2, 85.1, 166/105; 417/360, 423.15; 405/158, 169, 405/183.5, 184.4, 224.2, 224.3
See application file for complete search history.

(56) References Cited

U.S. PATENT DOCUMENTS

| | | | | |
|---|---|---|---|---|
| 3,638,732 | A * | 2/1972 | Huntsinger et al. | 166/379 |
| 4,589,492 | A * | 5/1986 | Greiner et al. | 166/338 |
| 5,671,811 | A * | 9/1997 | Head | 166/346 |
| 6,328,111 | B1 * | 12/2001 | Bearden et al. | 166/381 |
| 7,779,916 | B2 * | 8/2010 | Zemlak et al. | 166/336 |
| 2003/0056956 | A1 * | 3/2003 | Collie et al. | 166/336 |
| 2005/0189116 | A1 * | 9/2005 | See | 166/344 |
| 2006/0124314 | A1 * | 6/2006 | Haheim et al. | 166/368 |
| 2008/0105432 | A1 * | 5/2008 | Zemlak et al. | 166/336 |
| 2008/0277122 | A1 * | 11/2008 | Tinnen | 166/339 |

* cited by examiner

*Primary Examiner* — James Sayre
(74) *Attorney, Agent, or Firm* — Brandon S. Clark

(57) ABSTRACT

A technique for subsea operations utilizes a surface vessel to perform the installation and retrieval of submersible pumps or other tools with respect to a subsea well. A submersible pump is conveyed from a surface vessel to a subsea installation which is used to temporarily secure the submersible pump. Subsequently, the surface vessel is again used in cooperation with a conveyance to deliver the submersible pump to a desired location in a wellbore beneath the subsea installation.

21 Claims, 10 Drawing Sheets

SUBSEA DEPLOYMENT OF SUBMERSIBLE PUMP

CROSS-REFERENCE TO RELATED APPLICATION

The present document is based on and claims priority to U.S. Provisional Application Ser. No. 61/112,629, filed Nov. 7, 2008.

BACKGROUND

In a variety of subsea well related operations, the use of a submersible pump can be beneficial for producing fluid or for performing well servicing procedures. However, the installation and retrieval of submersible pumps to/from subsea wells are difficult procedures. Semi-submersible drilling rigs can be used to deploy, install and retrieve submersible pumps, but the use of such drilling rigs creates undesirable complexities, costs, and other difficulties that detract from the desirability of employing the submersible pump.

SUMMARY

In general, the present invention provides a methodology and system for utilizing a surface vessel to perform the installation and retrieval of submersible pumps with respect to a subsea well. A submersible pump is conveyed from a surface vessel to a subsea installation which is used to temporarily secure the submersible pump. Subsequently, the surface vessel is again used in cooperation with a conveyance to deliver the submersible pump to a desired location in a wellbore beneath the subsea installation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for deployment of a tool, such as a submersible pump, downhole in a subsea well. A methodology and system are provided for using a surface vessel, e.g. a mono hull vessel, to install and/or retrieve the tool from a subsea well.

According to one embodiment, a submersible pump is deployed to a desired location in a subsea wellbore by lowering the submersible pump from the surface vessel. The submersible pump is conveyed from the surface vessel to a subsea installation by a conveyance, such as a cable, and then the submersible pump is temporarily secured in the subsea installation. By way of example, the subsea installation may be positioned on the seabed and comprise an intervention package used to hang or otherwise secure the submersible pump. Subsequently, the submersible pump is lowered into the wellbore by a suitable conveyance, such as coiled tubing, until positioned at a desired location within the wellbore.

According to one methodology, the submersible pump is landed in preinstalled landing hardware and automatically connected to a preinstalled electrical cable that may be routed outside of production tubing. In an alternate methodology, an electrical cable may be deployed while attached to the submersible pump and terminated with an electrical cable termination positioned proximate the seabed. With these and other methodologies, the submersible pump can be retrieved by reversing the installation sequences, embodiments of which are described below.

Figure 1:
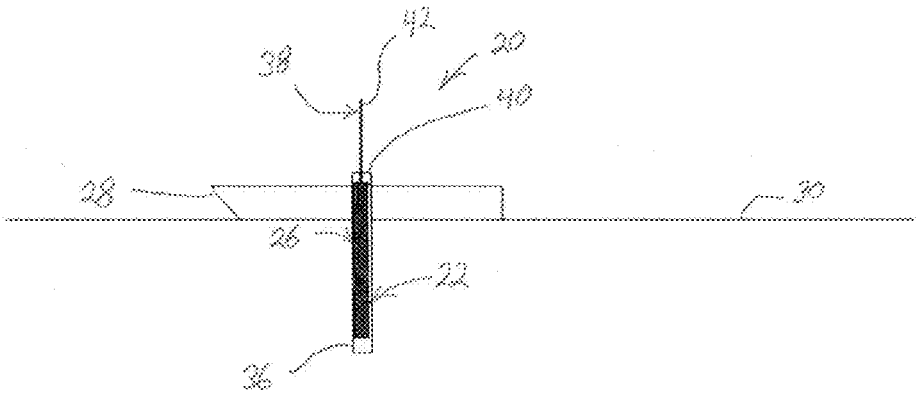
FIG. 1 is a schematic view of a surface vessel used to deploy a submersible pump to a subsea installation, according to an embodiment of the present invention.
Figure 1:
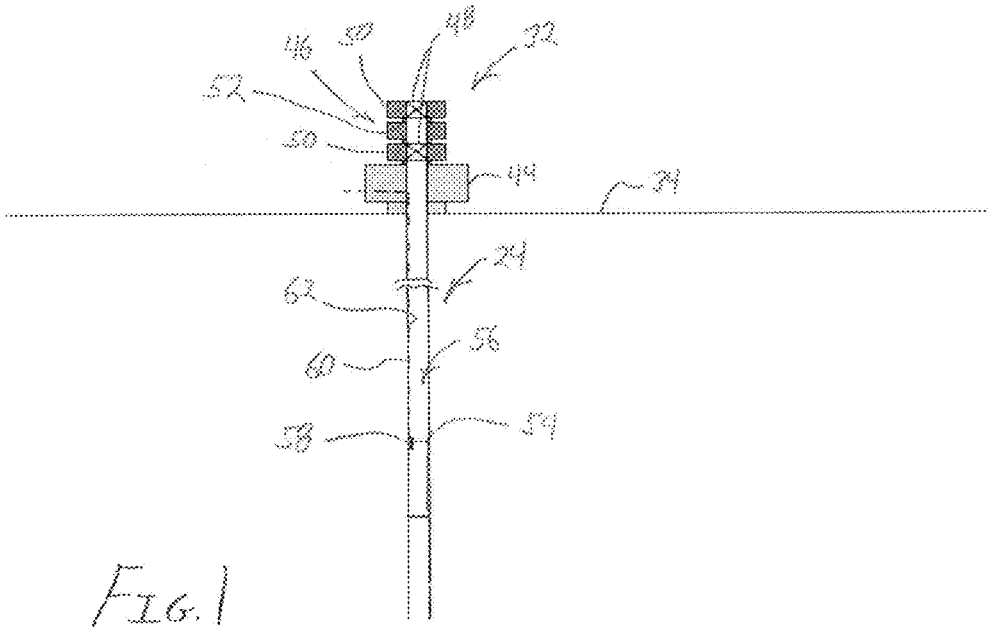

Referring generally to FIG. 1, an example of a system 20 for deploying a tool 22 in a subsea well 24 is illustrated. In this specific embodiment, tool 22 comprises a submersible pump that may be part of an overall electric submersible pumping system 26. The electric submersible pumping system 26 is deployed from a surface vessel 28, e.g. a mono hull surface vessel, located at a surface 30 of the sea. The surface vessel 28 is generally positioned above a subsea installation 32. By way of example, subsea installation 32 may be mounted at a seabed 34.

In the example illustrated, electric submersible pumping system 26 is positioned in a lubricator 36 while on surface vessel 28. The pumping system 26 and lubricator 36 are then lowered from surface vessel 28 via a conveyance 38. A dynamic seal 40 may be mounted on top of the lubricator 36 to seal against conveyance 38 when the pumping system 26 is deployed into the subsea installation 32. By way of example, conveyance 38 comprises a flexible conveyance that may be in the form of a cable 42, such as a crane wire, a wireline high strength cable, or another suitable flexible conveyance.

The subsea installation 32 may be constructed in a variety of configurations and with a variety of components. For example, subsea installation 32 may comprise a Christmas tree 44 positioned at seabed 34 and an intervention package 46 positioned above Christmas tree 44. While submersible pump 22 is being conveyed to subsea installation 32 from surface vessel 28, the subsea well 24 may be secured with barriers 48 of intervention package 46. Depending on the well operation to be performed, intervention package 46 is constructed with components selected to facilitate the desired operation. By way of example, intervention package 46 may comprise valves 50, used to selectively control barriers 48, combined with a securing mechanism 52 that may be in the form of pipe rams or other suitable devices used to secure, e.g. support, tool 22 in subsea installation 32, as described in greater detail below.

In the embodiment illustrated in FIG. 1, preinstalled hardware 54, e.g. a preinstalled completion, is positioned in a wellbore 56 of subsea well 24. The preinstalled hardware 54 is designed to receive and engage the tool/submersible pump 22 when landed in the preinstalled hardware. A preinstalled electrical connector 58 also is positioned in or proximate to the preinstalled hardware 54 and is connected to a preinstalled power cable 60. Power cable 60 is routed up to subsea installation 32 or to another desired location for connection to a power cable umbilical or to another source of electrical power. The preinstalled power cable 60 may be routed along the outside of a tubing 62, e.g. a production tubing, a casing, or another type of well tubing, in which the pumping system 26 is deployed and/or to which the pumping system is connected once delivered downhole into wellbore 56.

When electric submersible pumping system 26 is landed in preinstalled hardware 54, electrical connection with the pumping system is automatically formed via engagement with preinstalled electrical connector 58. By way of example, preinstalled electrical connector 58 may be part of an electrical wet connect that engages its corresponding component mounted on electric submersible pumping system 26.

Figure 2:
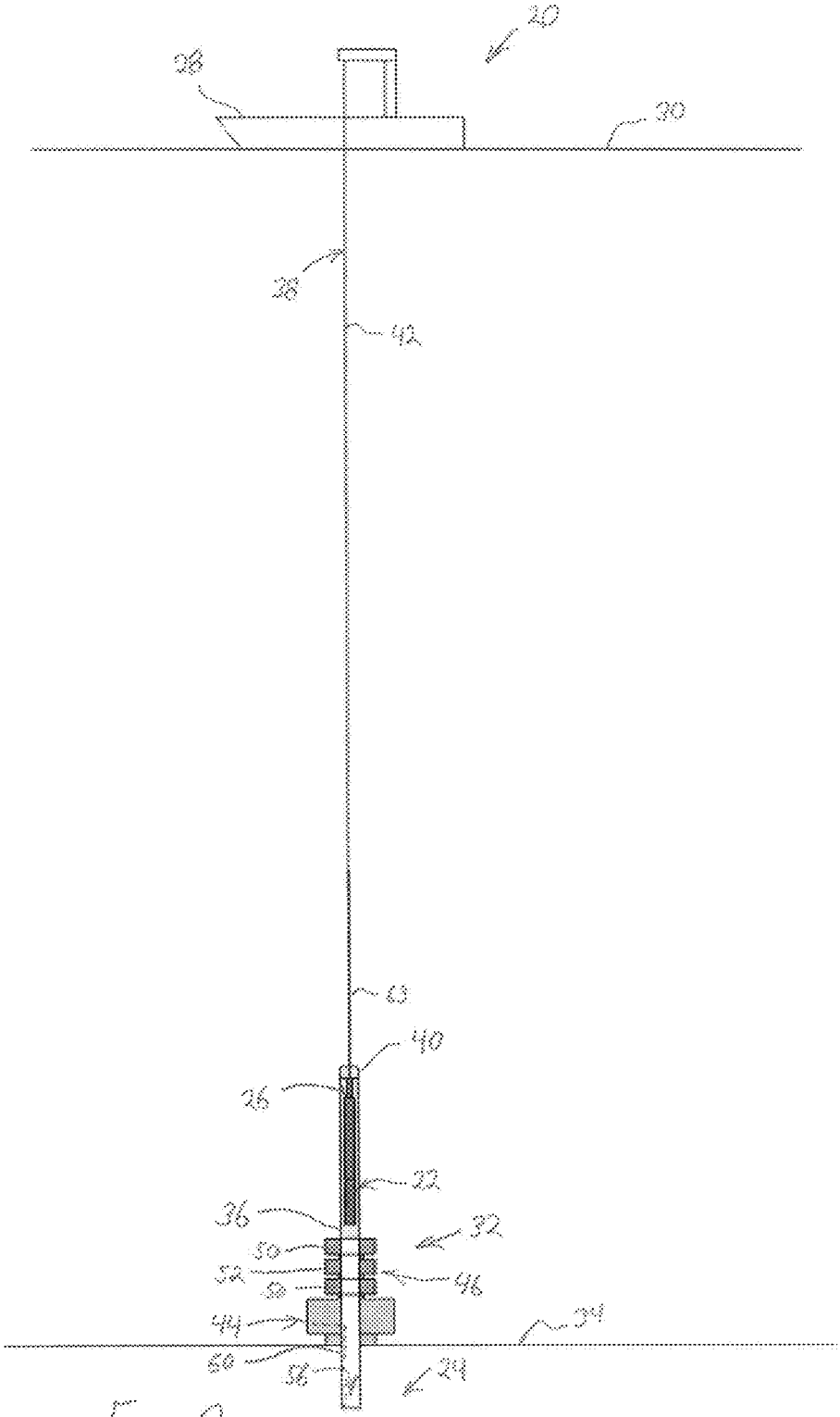
FIG. 2 is a view similar to that of FIG. 1 but showing the submersible pump deployed to the subsea installation, according to an embodiment of the present invention.

In FIG. 2, the submersible pump 22 and lubricator 36 have been lowered from surface vessel 28 via conveyance 38 to subsea installation 32. In this example, the lubricator 36 is connected to intervention package 46 and dynamic seal 40 is used to ensure a seal against conveyance 38. Once the seal is established against the conveyance, e.g. cable 42, the well barriers 48 may be opened to enable lowering of the submersible pump 22 into subsea installation 32. In this example, the entire electric submersible pumping system 26 is lowered into intervention package 46 of subsea installation 32.

Figure 3:
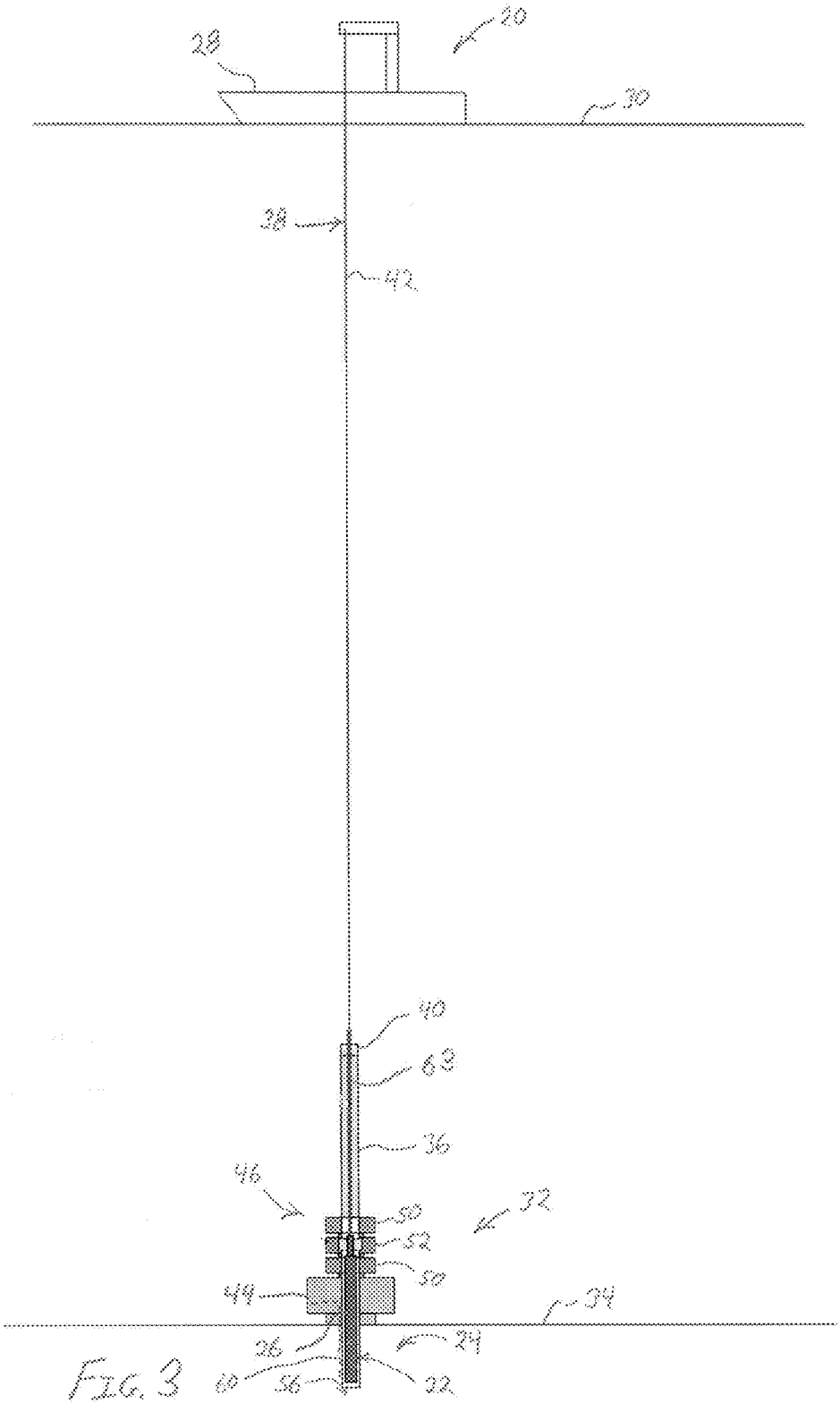
FIG. 3 is a view similar to that of FIG. 2 but showing the submersible pump positioned in the subsea installation, according to an embodiment of the present invention.

To facilitate formation of the seal against conveyance 38 via dynamic seal 40, the lower part of conveyance 38 may be formed as a cable with a flush, slick exterior surface 63 or as a rigid bar with the flush, slick exterior surface 63 to ensure maintenance of a seal as the electric submersible pumping system 26 is lowered into the subsea installation, as illustrated in FIG. 3. The smooth exterior surface 63 only needs to extend along a relatively short length of the conveyance 38, e.g. cable 42, because the length of conveyance lowered through the dynamic seal 40 is limited. If lubricator 36 is not long enough to cover the full length of the electric submersible pumping system 26, a valve can be employed in the well to provide a barrier to well pressure at a position that allows deployment of a toolstring longer than the lubricator.

Figure 4:
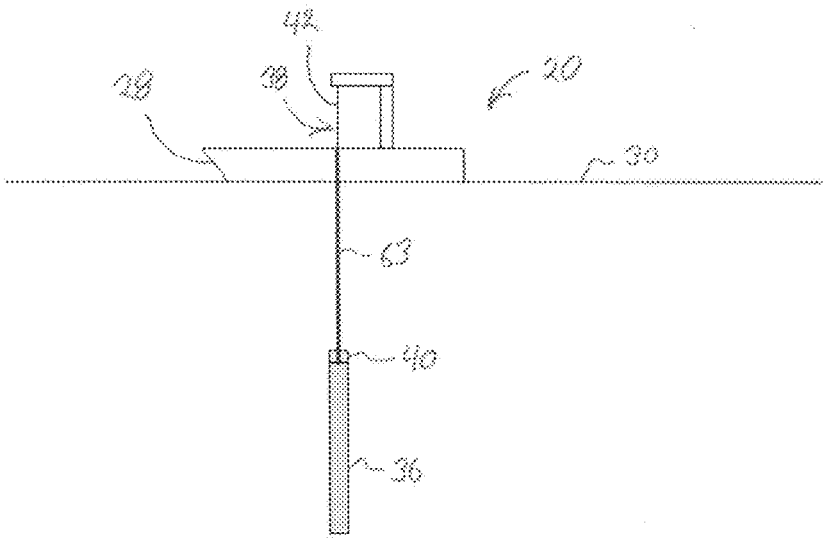
FIG. 4 is a view similar to that of FIG. 3 but showing the submersible pump secured in the subsea installation while a conveyance is retrieved to the surface vessel, according to an embodiment of the present invention.
Figure 4:
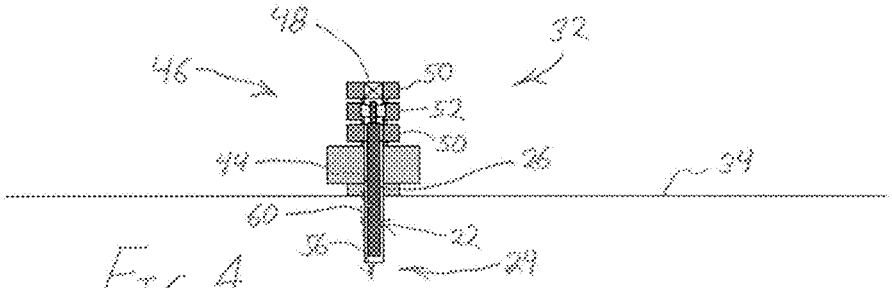

In FIG. 3, the electric submersible pumping system 26 has been delivered into subsea installation 32. Once an upper portion of pumping system 26 is within securing mechanism 52, the securing mechanism, e.g. pipe rams, are actuated to grab and secure the electric submersible pumping system in subsea installation 32. Subsequently, the conveyance 38 is disconnected from pumping system 26 and an upper barrier 48 of the intervention package 46 is closed, as illustrated in FIG. 4. The lubricator 36 may be disconnected from the intervention package 46 and retrieved to the surface vessel 28 via conveyance 38.

Figure 5:
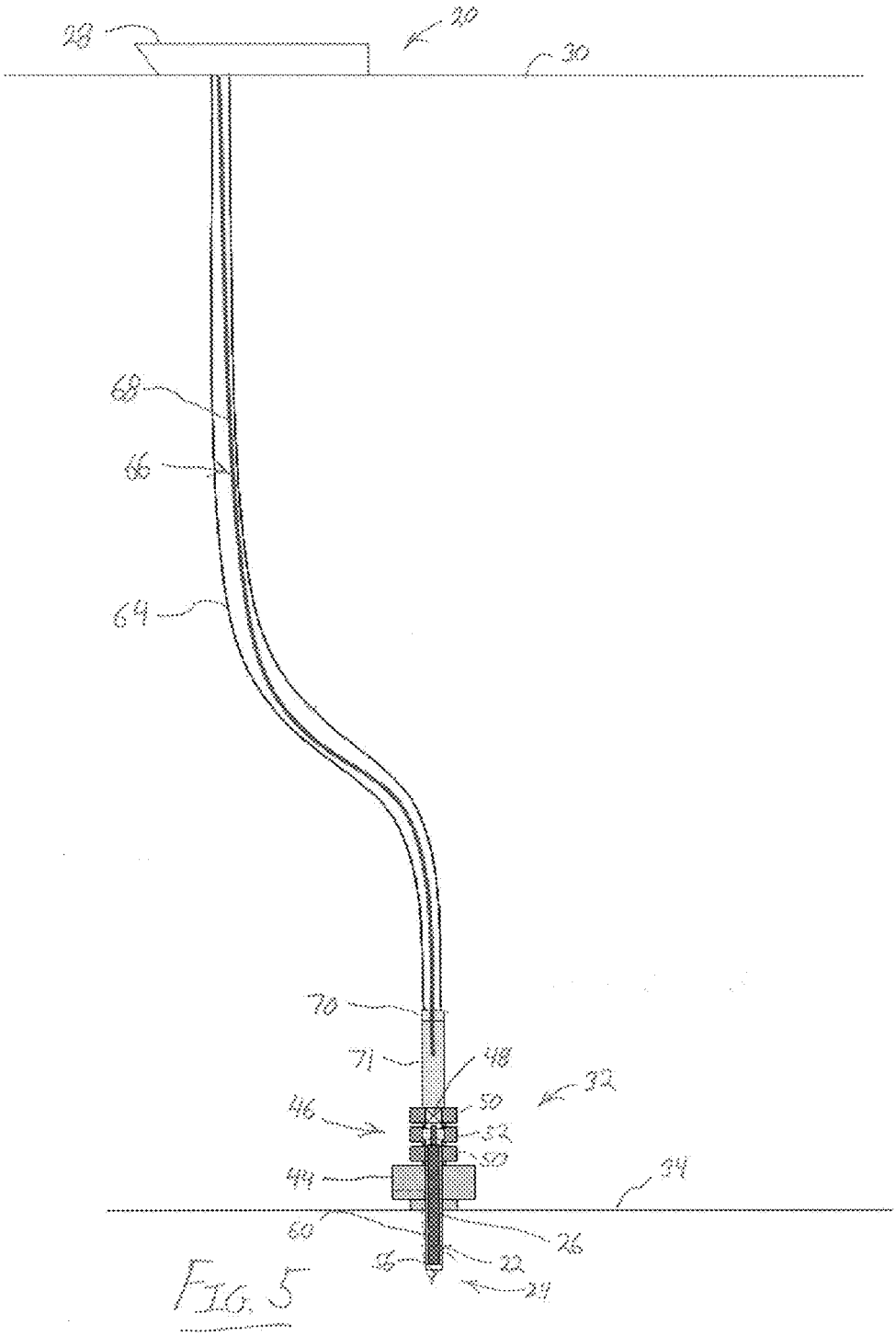
FIG. 5 is a view similar to that of FIG. 4 but showing a compliant guide engaged with the subsea installation, according to an embodiment of the present invention.

At this stage, a guide system 64 may be deployed from surface vessel 28 to subsea installation 32, as illustrated in FIG. 5. The guide system 64 provides an enclosed pathway between the surface vessel 28 and the subsea installation. By way of example, guide system 64 may comprise a spoolable compliant guide system, e.g. a spoolable compliant guide system available from Schlumberger Corporation, connected between surface vessel 28 and intervention package 46. Additionally, a second conveyance 66 is delivered from surface vessel 28 down through guide system 64 to the intervention package 46. By way of example, the conveyance 66 may comprise coiled tubing 68 and guide system 64 may comprise a dynamic seal 70. Guide system 64 also may comprise a lubricator 71 positioned below dynamic seal 70.

Figure 6:
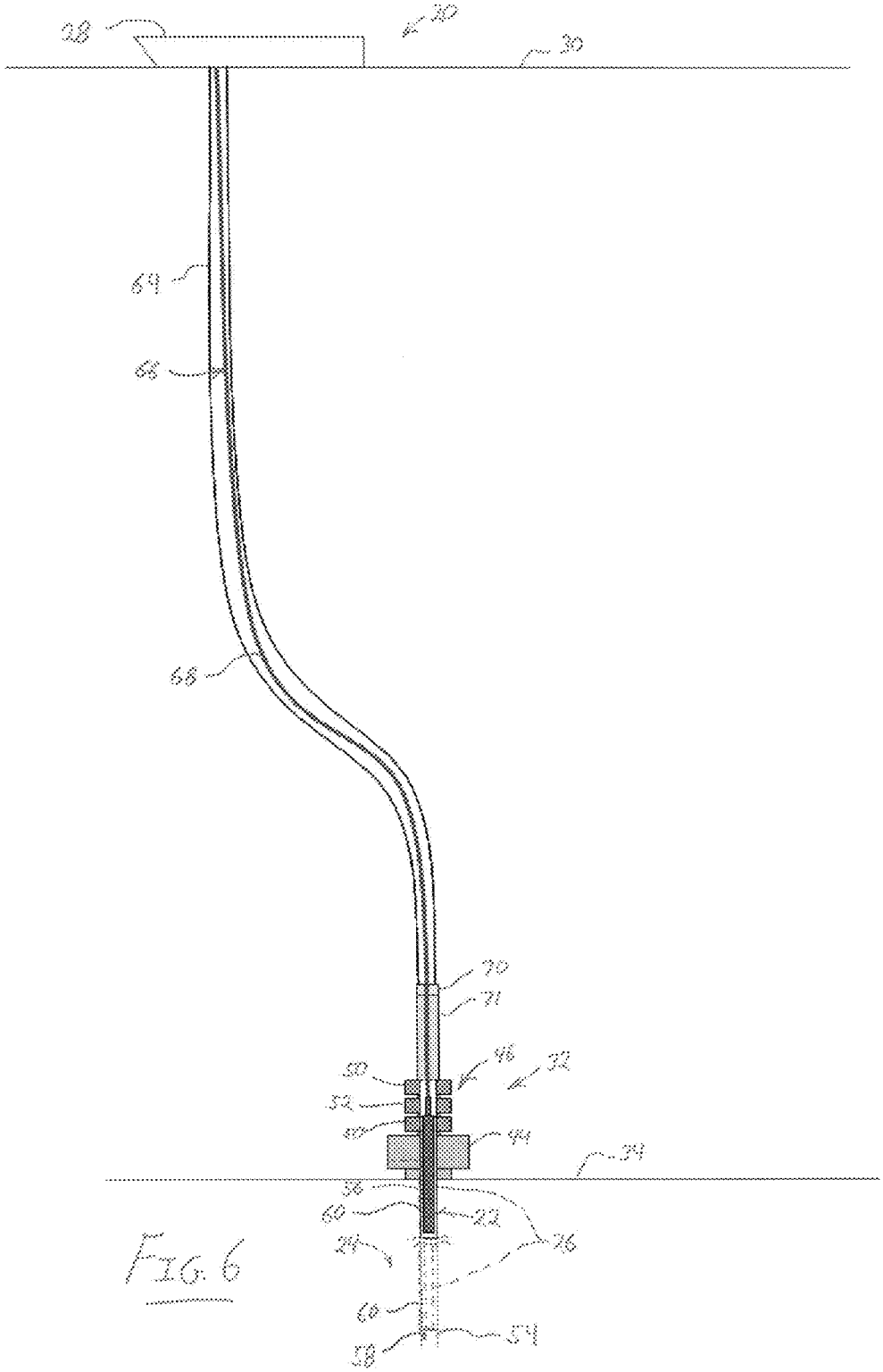
FIG. 6 is a view similar to that of FIG. 5 but showing an internal conveyance coupled to the submersible pump and moved through the compliant guide to deliver the submersible pump to a desired wellbore location, according to an embodiment of the present invention.

The dynamic seal 70 is activated against the coiled tubing 68 (or other suitable conveyance) to establish a pressure barrier as the lower end of coiled tubing 68 is moved into proximity with the intervention package 46. The upper barrier 48 of the intervention package may then be opened to enable connection of coiled tubing 68 with the upper end of electric submersible pumping system 26, as illustrated in FIG. 6. Once the connection has been made, securing mechanism 52 may be released by, for example, retracting the pipe rams to release the electric submersible pumping system. The coiled tubing 68 is then be used to lower submersible pump 22/pumping system 26 down into wellbore 56 until a desired wellbore location is reached.

For example, electric submersible pumping system 26 may be lowered into engagement with preinstalled hardware 54 as indicated by the dashed line silhouette of electric submersible pumping system 26 in FIG. 6. As pumping system 26 is landed in preinstalled hardware 54, the pumping system is automatically electrically engaged with preinstalled electrical connector 58 which can be powered via preinstalled power cable 60.

After delivering the submersible pump/tool 22 to the desired wellbore location, the coiled tubing 68 or other suitable conveyance may be released and retrieved to surface vessel 28. Following retrieval of the coiled tubing 68, pressure barriers are reestablished in Christmas tree 44 to enable activation of submersible pump 22. Reestablishing pressure barriers in Christmas tree 44 also allows the guide system 64 and intervention package 46 to be retrieved to surface vessel 28.

In an alternate embodiment, electrical power is provided to submersible pumping system 26 without installing power cable 60 or electrical connector 58 with a preinstalled completion, e.g. preinstalled hardware 54. In this alternate embodiment, the power cable is deployed when the submersible pump 22 is installed which enables a variety of additional well related applications, such as retrofit applications in which a submersible pump is retrofitted in an existing well.

In one embodiment, the alternate approach may be designed to deploy a power cable in the form of power lines installed inside coiled tubing, such as RedaCoil available from Schlumberger Corporation. The coiled tubing serves as a strength member to support the weight of the electric submersible pumping system during deployment into the subsea well 24 and it also protects the power lines during deployment. This approach provides a slick surface against which the dynamic seals can seal while the electric submersible pumping system is lowered through wellbore 56. In another embodiment of the alternate approach, the power cable comprises an umbilical type cable which may be deployed in a self-supporting manner inside the well. The umbilical type cable is designed with sufficient strength to support the weight of the pump. The cable also has a sufficiently slick exterior surface to enable proper operation of the dynamic seals while the electric submersible pumping system is lowered through wellbore 56.

Figure 7:
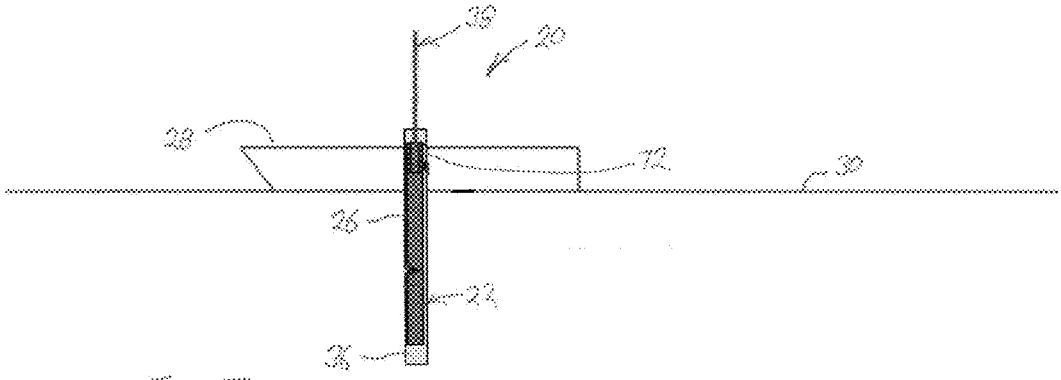
FIG. 7 is a schematic illustration of an alternate embodiment of a surface vessel and a submersible pump deployment system incorporating a hanger adapter, according to an embodiment of the present invention.

Referring generally to FIG. 7, one methodology for employing this alternate approach is illustrated. In the illustrated embodiment, the tool 22 (in this case the entire electric submersible pumping system 26) is rigged up at the surface vessel 28 inside lubricator 36 as discussed above with respect to the previous embodiment. However, an adaptor 72 is positioned at the top of the tool, which in the illustrated example is at the top of electric submersible pumping system 26. The adapter 72 may be constructed as a tubing hanger adapter designed to land in a tubing hanger at the subsea installation 32 when the electric submersible pumping system 26 is lowered into the well.

Figure 8:
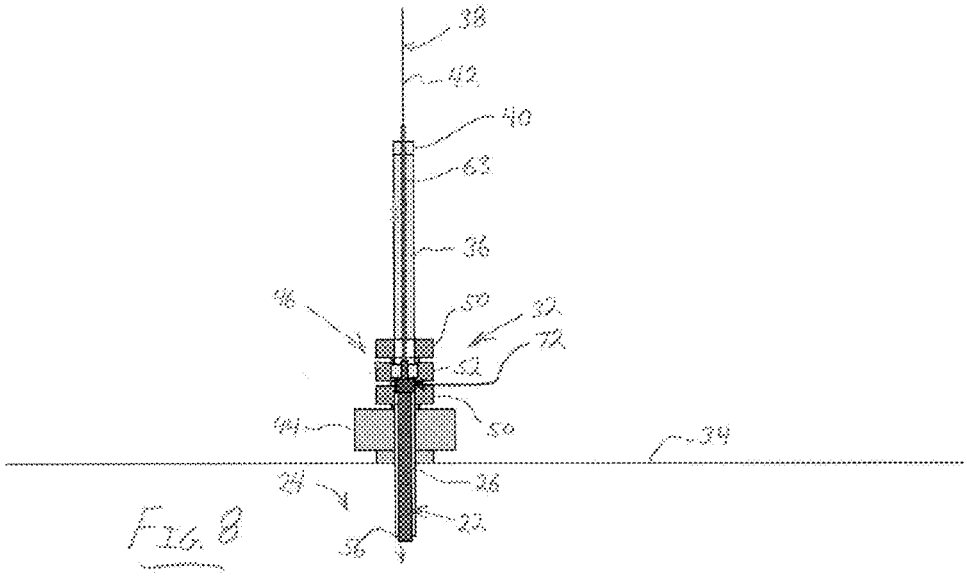
FIG. 8 is a schematic illustration of the alternate embodiment delivered to a subsea installation, according to an embodiment of the present invention.

After the pumping system 26 and adapter 72 are placed within lubricator 36, the assembly is lowered to subsea installation 32, as illustrated in FIG. 8. The lubricator 36 is engaged with intervention package 46, and barriers 48 are removed to enable movement of electric submersible pumping system 26 and adapter 72 into the subsea installation 32. The assembly is secured, e.g. hung, via securing mechanism 52 which may be in the form of pipe rams designed to grab the assembly.

Figure 9:
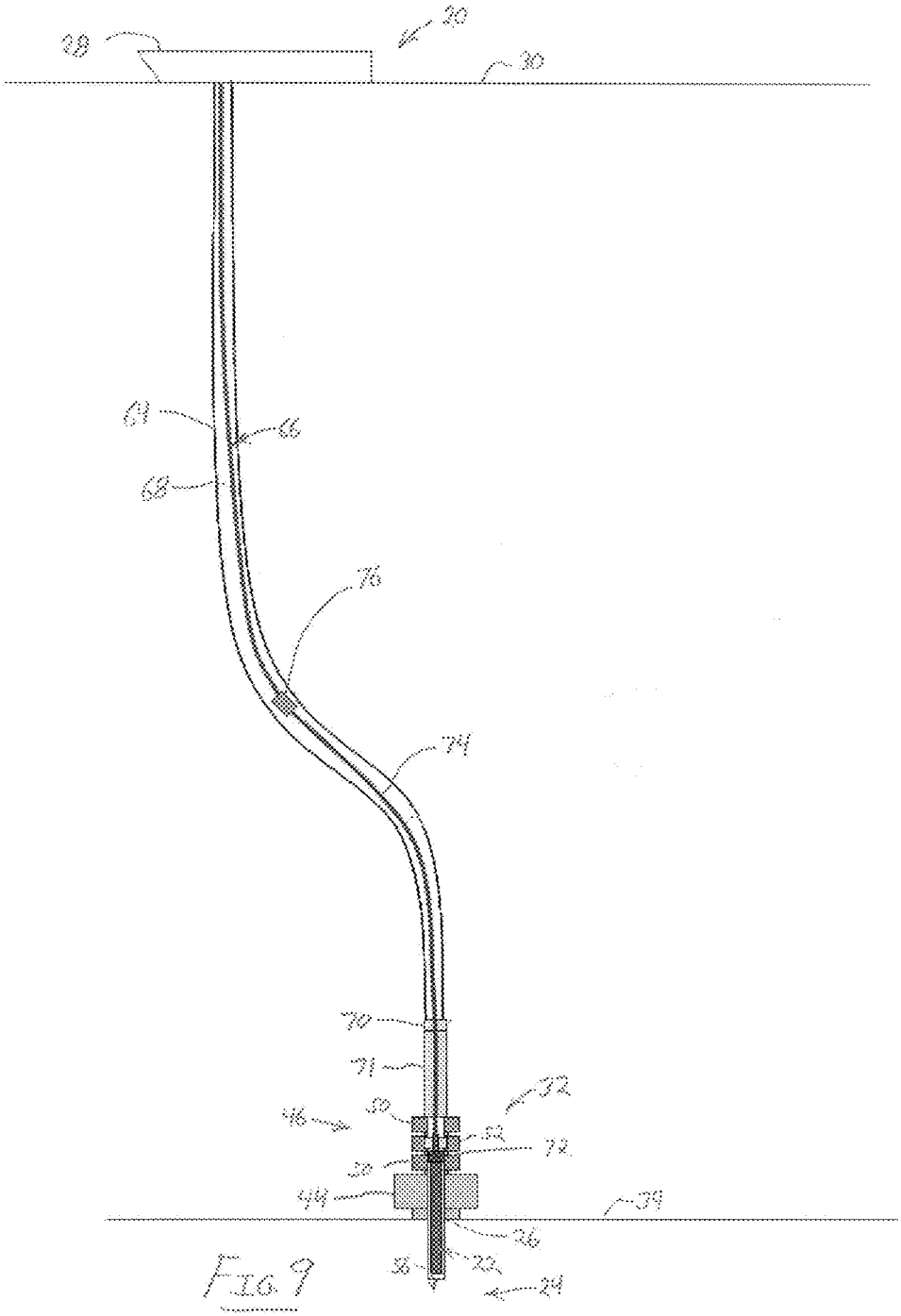
FIG. 9 is a schematic illustration of the alternate embodiment supported in the subsea installation while a compliant guide is connected to the subsea installation, according to an embodiment of the present invention.

Once the electric submersible pumping system 26 is supported by securing mechanism 52, the upper barrier 48 is closed and the lubricator 36 may be retrieved to allow deployment of guide system 64, e.g. a spoolable compliant guide system, as illustrated in FIG. 9. Instead of delivering coiled tubing through the guide system 64, a pump power cable 74 is connected to the lower end of conveyance 66, e.g. coiled tubing 68, and delivered to the electric submersible pumping system 26 for connection, as illustrated. By way of example, pump power cable 74 may comprise an umbilical type of power cable or an instrumented tubing, such as RedaCoil which is available from Schlumberger Corporation. The upper end of the pump power cable 74 comprises a power cable termination 76 that may be landed in the hanger adapter 72.

The length of the pump power cable 74 is selected to match the distance between the upper end of the electric submersible pumping system 26 and the installed position of power cable termination 76 when landed in hanger adapter 72. As discussed below, the adapter 72 may be landed in Christmas tree 44.

Figure 10:
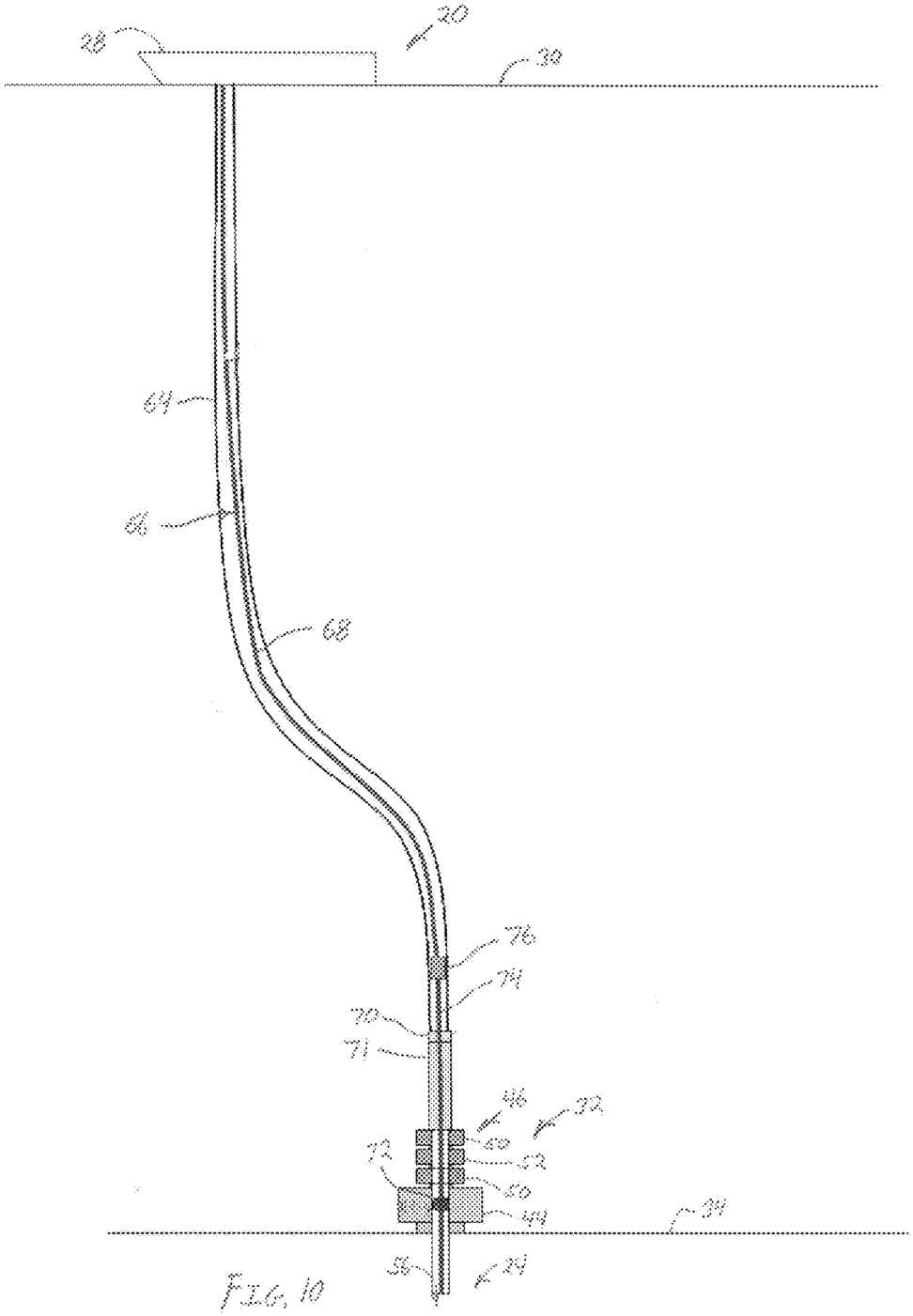
FIG. 10 is a schematic illustration of the alternate embodiment in which a submersible pump is delivered into the wellbore via a power cable having a power cable termination designed for engagement with the hanger adapter, according to an embodiment of the present invention.

After engaging the lower end of pump power cable 74 with electric submersible pumping system 26, the pumping system is lowered into wellbore 56 and tubing hanger adapter 72 is landed in Christmas tree 44, as illustrated in FIG. 10. The pump power cable 74 moves freely through adapter 72 until termination 76 is landed in the adapter. It should be noted that the subsea dynamic seals, e.g. dynamic seal 70, are temporarily opened to enable passage of the pump cable termination 76 and then closed against coiled tubing 68. In this example, the diameter of pump power cable 74 is the same as the diameter of coiled tubing 68 to facilitate formation of sufficient sealing via the dynamic seal or seals.

Figure 11:
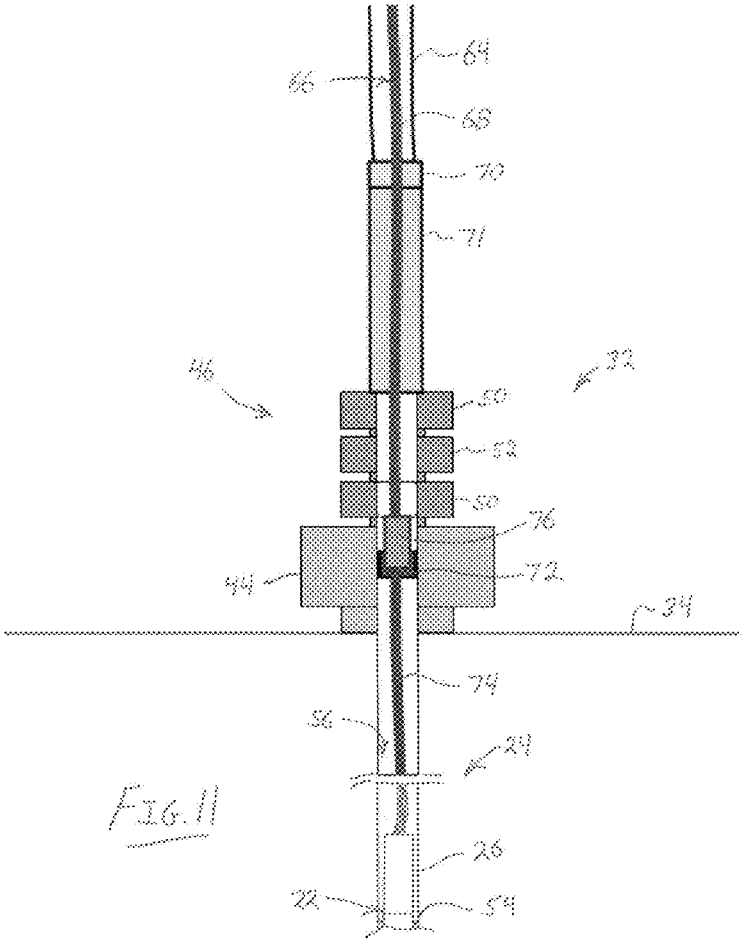
FIG. 11 is a schematic illustration of the alternate embodiment in which the power cable termination is supported in the hanger adapter, according to an embodiment of the present invention.

As illustrated in FIG. 11, once the power cable termination 76 is moved past the dynamic seal or seals, the pumping system 26 is landed in downhole landing hardware 54. The coiled tubing 68 is then lowered a small, additional amount until the power cable termination 76 lands in the tubing hangar adapter 72, as illustrated. Both the tubing hanger adapter 72 and the power cable termination 76 are designed to provide suitable pressure barriers to secure the subsea well. Additionally, the power cable termination 76 may be locked into tubing hanger adapter 72 to prevent unwanted separation.

Figure 12:
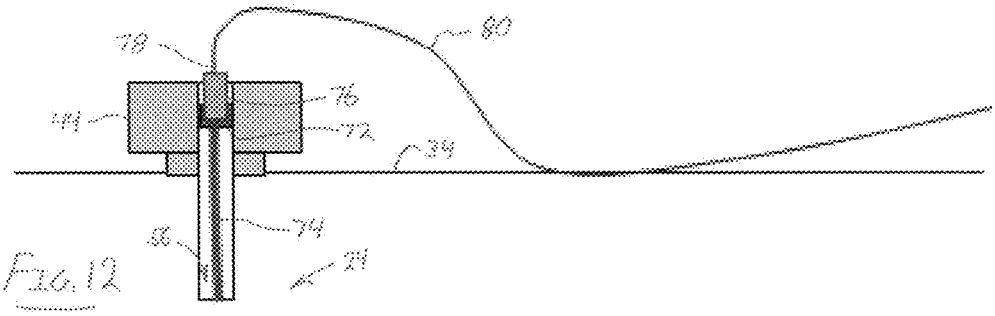
FIG. 12 is a schematic illustration of the alternate embodiment in which a separate power cable has been engaged with the power cable termination to provide electrical power to the submersible pump, according to an embodiment of the present invention.

At this stage, the coiled tubing 68 may be disconnected and retrieved to the surface vessel 28. Additionally, the guide system 64, dynamic seal 70, any lubricator positioned below the dynamic seal 70, and intervention package 46 also may be retrieved to surface vessel 28. The power cable termination 76 is designed to receive an electrical wet connector 78, as illustrated in FIG. 12. By way of example, the electrical wet connector 78 may be stabbed into power cable termination 76 by a remotely operated vehicle (ROV). Engagement of the wet connector 78 and a corresponding power cable 80 enable operation of the submersible pump 22.

With the embodiments described above, the electric submersible pumping system 26 or other type of tool 22 is readily retrieved to the surface vessel 28. The sequence of events for installing the pumping system 26/tool 22, as described above, is simply reversed to enable retrieval of the equipment upon completion of the desired well related operation.

System 20 may be constructed in a variety of configurations for use in many types of subsea wells. For example, the submersible pump may be constructed in several configurations and sizes. Additionally, the submersible pump may be combined with many types of other components to provide electric submersible pumping systems suitable for desired applications. The subsea installation also may incorporate various components to facilitate installation and/or retrieval of tools or to enable other well related functions. Consequently, the Christmas tree and intervention package may be constructed in suitable corresponding configurations. Similarly, the first and second conveyances used in the installation and/or retrieval procedures may be selected according to the various goals or constraints of a given application.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of deploying a pumping system into a subsea well, comprising:

coupling an electric submersible pumping system to a conveyance;

lowering the electric submersible pumping system from a surface vessel to a subsea installation via the conveyance;

supporting the electric submersible pumping system within the subsea installation;

releasing the conveyance from the electric submersible pumping system;

temporarily closing an upper barrier of the subsea installation above the electric submersible pumping system;

deploying a guide system to the subsea installation;

delivering a second conveyance to the electric submersible pumping system through the guide system; and subsequently moving the electric submersible pumping system downhole into a wellbore beneath the subsea installation via the second conveyance.

2. The method as recited in claim 1, further comprising landing the electric submersible pumping system in preinstalled landing hardware and automatically connecting the electric submersible pumping system to a preinstalled electrical cable.

3. The method as recited in claim 1, wherein coupling comprises coupling the electric submersible pumping system to a flexible conveyance.

4. The method as recited in claim 1, wherein lowering comprises lowering the electric submersible pumping system while the electric submersible pumping system is contained within a lubricator.

5. The method as recited in claim 4, wherein lowering comprises engaging the lubricator with the subsea installation until the electric submersible pumping system is supported in the subsea installation.

6. The method as recited in claim 1, wherein subsequently moving comprises moving the electric submersible pumping system via the second conveyance in the form of a coiled tubing delivered through the guide system in the form of a spoolable compliant guide.

7. The method as recited in claim 6, further comprising utilizing a dynamic seal on the spoolable compliant guide to seal against the coiled tubing and to maintain a pressure barrier during movement of the electric submersible pumping system to a desired wellbore location.

8. The method as recited in claim 1, further comprising deploying a power cable to the electric submersible pumping system with coiled tubing.

9. The method as recited in claim 1, further comprising providing power to the electric submersible pumping system through an umbilical cable.

10. The method as recited in claim 8, wherein deploying further comprises landing a power cable termination of the power cable in a tubing hanger adapter positioned in the subsea installation.

11. A method of installing a pump in a subsea well, comprising:

lowering an electric submersible pump from a surface vessel;

hanging the electric submersible pump in an intervention package of a subsea installation positioned at a seabed;

releasing a conveyance from the electric submersible pump and enclosing the electric submersible pump;

deploying a guide system to the subsea installation;

delivering a second conveyance to the electric submersible pumping system through the guide system; and subsequently moving the electric submersible pump through a wellbore beneath the subsea installation via the second conveyance.

12. The method as recited in claim 11, wherein lowering comprises lowering the electric submersible pump from the surface vessel via a cable.

13. The method as recited in claim 12, further comprising landing the electric submersible pump in preinstalled landing hardware in the wellbore in a manner that electrically connects the electric submersible pump with a preinstalled electrical cable.

14. The method as recited in claim 11, wherein hanging comprises closing an upper pressure barrier of the intervention package until the electric submersible pump is to be connected with the coiled tubing.

15. The method as recited in claim 11, wherein moving comprises moving coiled tubing through the guide system connected between the surface vessel and the subsea installation.

16. The method as recited in claim 11, wherein hanging comprises hanging the electric submersible pump in the subsea installation via pipe rams of the intervention package.

17. The method as recited in claim 11, further comprising supplying electricity to power the electric submersible pump, when located at a desired wellbore location, via an electrical cable extending from the electric submersible pump to an electrical cable termination landed within the subsea installation.

18. A method, comprising:

conveying an electric submersible pumping system from a surface vessel to an intervention package located at a seabed with a first conveyance;

securing the electric submersible pumping system at the intervention package;

after securing the electric submersible pumping system, deploying a guide system to the intervention package; and subsequently deploying a second conveyance through the guide system to deliver the electric submersible pumping system to a desired location in a wellbore beneath the intervention package.

19. The method as recited in claim 18, wherein conveying comprises conveying the electric submersible pumping system inside a lubricator.

20. The method as recited in claim 18, wherein conveying comprises conveying the electric submersible pumping system with a cable.

21. The method as recited in claim 20, wherein subsequently deploying comprises using coiled tubing to deliver the electric submersible pumping system to the desired location.

* * * * *